US009376941B2

(12) United States Patent
Yang

(10) Patent No.: US 9,376,941 B2
(45) Date of Patent: Jun. 28, 2016

(54) METHOD AND APPARATUS FOR RESETTING VALVE LIFT FOR USE IN ENGINE BRAKE

(75) Inventor: Zhou Yang, Oak Ridge, NC (US)

(73) Assignee: Shanghai Universoon Autoparts Co., Ltd., Shanghai (CN)

( * ) Notice: Subject to any disclaimer, the term of this patent is extended or adjusted under 35 U.S.C. 154(b) by 218 days.

(21) Appl. No.: 13/985,554

(22) PCT Filed: Sep. 5, 2011

(86) PCT No.: PCT/CN2011/001505

§ 371 (c)(1),
(2), (4) Date: Aug. 14, 2013

(87) PCT Pub. No.: WO2012/109780

PCT Pub. Date: Aug. 23, 2012

(65) Prior Publication Data

US 2013/0319370 A1 Dec. 5, 2013

(30) Foreign Application Priority Data

Feb. 15, 2011 (CN) ..... 2011 1 0038446
Mar. 16, 2011 (CN) ..... 2011 1 0062797

(51) Int. Cl.

| | |
|---|---|
| ***F01L 13/06*** | (2006.01) |
| ***F01L 1/08*** | (2006.01) |
| ***F01L 1/14*** | (2006.01) |
| ***F01L 1/18*** | (2006.01) |
| ***F01L 1/20*** | (2006.01) |
| ***F01L 1/24*** | (2006.01) |

(Continued)

(52) U.S. Cl.

CPC ..... *F01L 13/065* (2013.01); *F01L 1/08* (2013.01); *F01L 1/146* (2013.01); *F01L 1/181* (2013.01);

(Continued)

(58) Field of Classification Search

CPC ..... F01L 13/065; F01L 13/08; F01L 13/04; F02D 41/12; F02D 9/06
USPC ..... 123/320, 322, 321, 90.15, 90.12
See application file for complete search history.

(56) References Cited

U.S. PATENT DOCUMENTS 6,718,940 B2 4/2004 Usko
8,065,987 B2 * 11/2011 Yang ..... 123/321

(Continued)

FOREIGN PATENT DOCUMENTS

CN 101392667 A 3/2009
CN 101769186 A 7/2010

OTHER PUBLICATIONS

Chinese 1st Office Action with Partial English Translation, dated Oct. 10, 2013 for Application No. 201110038446.X.

*Primary Examiner* — Mahmoud Gimie
(74) *Attorney, Agent, or Firm* — RuyakCherian LLP

(57) ABSTRACT

A method and apparatus for resetting a valve lift for use in an engine brake. A brake piston (160), and a hydraulic fluid passage (214) are arranged within a rocker arm (210) or a valve bridge (400) of an engine. A resetting valve arranged between the rocker arm (210) and the valve bridge (400) is driven by a change in the distance between the rocker arm (210) and the valve bridge (400). When the valve lift of an engine exhaust valve (300) reaches a maximum, a reset fluid passage (219) is opened, the hydraulic pressure within the hydraulic fluid passage is released, the brake piston (160) is reversed by one interval, the motion transmission between a cam (230) and the engine exhaust valve (300) is partially disengaged, and the valve lift of the engine exhaust valve (300) is reduced. Also, during a returning process of the valve lift of the engine exhaust valve (300) after reaching the maximum position, repositioning of the reset valve is used to maintain a supply of pressure within the hydraulic fluid passage, the brake piston (160) is allowed to be positioned at an extended position, and the motion transmission between the cam (230) and the engine exhaust valve (300) is resumed. The apparatus for resetting the valve lift can be integrated within an engine exhaust valve brake, and is structurally simple, convenient to install and to adjust, thereby improving safety and reliability.

15 Claims, 7 Drawing Sheets

(51) Int. Cl.

| | |
|---|---|
| ***F01L 1/26*** | (2006.01) |
| ***F01L 13/00*** | (2006.01) |
| ***F02D 13/04*** | (2006.01) |

(52) U.S. Cl.

CPC ... *F01L 1/20* (2013.01); *F01L 1/24* (2013.01); *F01L 1/26* (2013.01); *F01L 13/0031* (2013.01); *F01L 13/06* (2013.01); *F02D 13/04* (2013.01)

(56) References Cited

U.S. PATENT DOCUMENTS

| | | | | |
|---|---|---|---|---|
| 2010/0170471 | A1* | 7/2010 | Yang | 123/321 |
| 2010/0170472 | A1* | 7/2010 | Yang | 123/321 |

* cited by examiner

METHOD AND APPARATUS FOR RESETTING VALVE LIFT FOR USE IN ENGINE BRAKE

FIELD OF THE INVENTION

The present application relates to the mechanical field, specifically to the valve actuation technology for vehicle engines, particularly to method and apparatus for resetting valve lift for an engine brake.

BACKGROUND OF THE INVENTION

In the prior art, the engine brake technology is well known. Engine braking can be achieved by temporarily converting the engine into a compressor. In the conversion process, the fuel is cut off, and the exhaust valve is opened near the end of the compression stroke of the engine piston, thereby allowing the compressed gases (being air during braking) to be released. The energy absorbed by the compressed gas during the compression stroke of the engine cannot be returned to the engine piston in the subsequent expansion stroke, but is dissipated by the engine exhaust and cooling systems. The above process finally results in an effective engine braking and the slow-down of the vehicle.

The engine brake includes Compression Release Brake and Bleeder Brake. In an engine using the Compression Release Brake, the exhaust valve is opened near the end of the compression stroke of the engine piston, and is closed after the compression stroke (during the early stage of the expansion or power stroke, prior to the normal opening of the exhaust valve). In an engine using the Bleeder Brake, the exhaust valve is kept slightly open with a constant lift in addition to the normal exhaust valve opening during a part of the engine cycle (Partial Cycle Bleeder Brake) or during the non-exhaust stroke (i.e. the intake stroke, the compression stroke and the expansion or power stroke) of the engine cycle (Full Cycle Bleeder Brake). The main difference between the Partial Cycle Bleeder Brake and the Full Cycle Bleeder Brake is that the former does not open the exhaust valve during most of the intake stroke.

An example of a conventional engine brake device is a hydraulic-type engine brake provided by Cummins in the disclosure of U.S. Pat. No. 3,220,392 in 1965. In the conventional engine brake, a mechanical input is transmitted to an exhaust valve to be opened through a hydraulic circuit. A master piston reciprocating in a master piston bore is located in the hydraulic circuit. The reciprocating motion comes from the mechanical input of the engine, such as the motion of the engine's fuel injection cam or the neighboring exhaust cam. The motion of the master piston is transmitted through hydraulic fluid to a slave piston located in the hydraulic circuit, causing the slave piston to reciprocate in a slave piston bore. The slave piston acts, directly or indirectly, on the exhaust valve, thereby generating the valve event for the engine braking operation.

The engine brake device disclosed by Cummins is a bolt-on accessory that fits above the engine. In order to mount the engine brake, a spacer needs to be provided between the cylinder and the valve cover, such that the height, weight and cost of the engine are additionally increased. Obviously, the solution to the above problems is to integrate the components of the braking device in the existing components of the engine, such as in the rocker arm or in the valve bridge of the engine, thereby forming an integrated brake. The integrated engine brakes in the prior art have the following forms.

1. Integrated Rocker-Arm Brake

An integrated compression release engine brake system was disclosed by Jonsson in U.S. Pat. No. 3,367,312 in 1968. The brake system is integrated in a rocker arm of the engine, and a plunger or a slave piston is positioned in a rocker-arm cylinder arranged at one end, close to an exhaust valve, of the rocker arm and is locked in a protruding position hydraulically, such that a cam motion can be transmitted to one exhaust valve (there is only one valve per cylinder in an early engine) to generate the engine braking operation. As disclosed by Jonsson, a spring is provided for biasing the plunger outward from the cylinder to be in continuous contact with the exhaust valve so as to allow the cam-actuated rocker arm to operate the exhaust valve in both the power and braking modes. In addition, a control valve is used to control the flow of pressurized fluid to the rocker-arm cylinder so as to realize selective switching between a braking operation and a normal power operation.

A different integrated rocker-arm brake was disclosed by the Mack Truck Company of the United States in U.S. Pat. No. 3,786,792 in 1974. The braking piston of the brake system is positioned in a rocker-arm cylinder arranged at one end, close to a push rod, of the rocker arm and is hydraulically locked in the protruding position, such that the motion of the cam is transmitted to an exhaust valve (there is only one valve per cylinder in an early engine) to produce the engine braking operation. A conventional cam lobe and a braking cam lobe are integrated in the above cam. The brake control valve mechanism (a combination of a funnel-shaped plunger valve and a one-way ball valve) in the above brake system was widely used after its disclosure.

Another integrated rocker-arm brake is disclosed by the Jacobs Company (JVS) of the United States in U.S. Pat. No. 3,809,033 in 1974. The braking piston of the brake system is positioned in a rocker-arm cylinder arranged at one end, close to the valve bridge, of the rocker arm, and is movable between a non-braking position and a braking position. In the braking position, the braking piston is hydraulically locked in a protruding position, such that the cam motion is transmitted to the valve bridge to open two exhaust valves (the engine has two valves per cylinder) for producing the engine brake operation. The braking system uses two separate oil passages, one for supplying oil to the brake, and the other being a conventional engine lubrication oil passage.

An integrated rocker-arm brake system for an overhead cam four-valve engine was disclosed by Sweden's Volvo Company in U.S. Pat. No. 5,564,385 in 1996, which is very similar in both structure and principle to the integrated rocker-arm brake disclosed by Jacobs Company (JVS) in U.S. Pat. No. 3,809,033 in 1974. The hydraulic braking piston is positioned in a rocker-arm cylinder arranged at one end, close to the valve bride, of the rocker arm and is movable between a non-braking position and a braking position and forms a gap in the engine air valve system. Oil with a certain pressure is supplied to the braking piston by a pressure control valve to fill the gap in the rocker arm so as to form a hydraulic linkage. The engine braking system adopted the combined structure having a funnel-shaped plunger valve and a one-way ball valve and added an overload pressure relief mechanism, and an oil supply device for providing dual oil pressures via a single oil passage, wherein a low oil pressure (below the engine lubricating oil pressure) is used for the engine lubrication, and a high oil pressure (equal to the engine lubricating oil pressure) is used for the engine brake. During engine braking, the braking piston drives the valve bridge to open the two exhaust valves simultaneously.

Another new integrated rocker-arm brake was disclosed by the Mack Truck Company of the United States in U.S. Pat.

No. 6,234,143 in 2001, which is quite different from the technology disclosed in U.S. Pat. No. 3,786,792 in 1974. First of all, an Exhaust Gas Recirculation (EGR) cam lobe was added to the integrated cam formed with the conventional cam lobe and the braking cam lobe, which facilitates improving the braking power. Secondly, the engine with a single valve per cylinder is changed into an engine with dual valves per cylinder, and a valve bridge (an air valve bridge or a cross arm) was added. Further, the braking piston in the rocker-arm piston bore is moved from the push rod side to the valve bridge side, and is located above the exhaust valve (an inner valve) next to the rocker-arm shaft. During braking, the braking piston opens one exhaust valve via a braking top block or by a direct action on the valve bridge. However, since only one valve is opened for braking, the valve bridge is in an inclined state and an asymmetric load is generated on the valve bridge and the rocker arm. Furthermore, the braking valve (the inner valve) lift profile is greater than the non-braking valve (an outer valve) or the conventional valve lift profile (larger opening and later closing).

An integrated rocker-arm brake system having a valve lift reset mechanism was disclosed by Cummins Engine Company in U.S. Pat. No. 6,253,730 in 2001 to resolve the problems of the one-valve (the inner valve) braking, such as the asymmetric load and the braking valve (the inner valve) lift profile being greater than the non-braking valve (the outer valve) or the conventional valve lift profile (larger opening and later closing). The valve lift reset mechanism resets or retracts the braking piston in the rocker arm before the braking valve reaches its peak valve lift, which allows the braking valve to return to the valve seat before the start of the main valve action, such that the valve bridge returns to the horizontal position, and the rocker arm can open the braking valve and the non-braking valve evenly, thereby eliminating any asymmetric load.

However, there are a lot of problems with resetting the engine braking system before the braking valve reaching its peak valve lift. Firstly, during engine braking, both the opening time and the lift magnitude of the braking valve are very short, thus the time for resetting is very limited. Secondly, the resetting occurs when the engine braking load is close to the maximum (i.e. the top dead center of the compression stroke), thereby causing the reset valve of the valve lift reset mechanism to bear a high oil pressure or a large load. Thus, the engine brake resetting timing is essential. If the resetting occurs too early, the loss of braking valve lift is too much (causing a lower valve lift and the valve to be closed too early), which may reduces the braking performance. If the resetting occurs too late, the braking valve can not be closed before the start of the main valve action, which may results in an asymmetric load. Tests show that the integrated rocker-arm brake cannot work properly at high engine speeds, because the resetting time is too short, the resetting height is too small, and the load or pressure on the reset valve is very high.

2. Integrated Valve Bridge Brake

An example of a conventional integrated valve bridge brake was disclosed by Calvin in U.S. Pat. No. 3,520,287 in 1970. The entire valve bridge is set on a central guide rod. The guide rod is provided with an internal brake oil passage and a control valve. An upper portion of the guide rod acts as a braking piston, the valve bridge slides along the braking piston through a piston bore in the valve bridge. The disadvantage of this apparatus is that there is always a large relative motion between the braking piston and the piston bore in the valve bridge.

An improved valve bridge brake mechanism was disclosed by Sickler in U.S. Pat. No. 4,572,114 in 1986. A dedicated braking piston is housed in a piston bore opened upward at the center of the valve bridge, such that the relative motion between the braking piston and the valve bridge is greatly reduced. The valve bridge brake mechanism was designed for a four-stroke engine, but each engine cycle produces two compression release braking events.

Recently, the Jacobs Company (JVS) of the United State designed and manufactured a valve bridge brake device (see U.S. Publication No. 20050211206 and No. 20070175441) for Hyundai Truck Company in South Korea. Wherein, a valve lift reset mechanism was added to the valve bridge brake mechanism disclosed by Sickler in U.S. Pat. No. 4,572,114 in 1986. But similar to the valve lift reset mechanism disclosed by Cummins Engine Company in U.S. Pat. No. 6,253,730 in 2001, the reset valve of the valve lift reset mechanism is located in the exhaust valve actuator (in the rocker arm for Cummins and in the valve bridge for JVS), while the reset top block or the reset rod is located on the engine, such that it is very difficult to ensure the height and timing for resetting the braking valve lift, and it is also not convenient for installation, transportation and adjustment.

SUMMARY OF THE INVENTION

An object of the present application is to provide a method for resetting a valve lift for an integrated engine brake, so as to solve technical problems of a valve lift reset device of an integrated engine braking in the prior art, such as having a poor precision and being inconvenient for installation and adjustment.

The method of the present application for resetting a valve lift of an integrated engine brake includes a process of utilizing a motion of a cam to open an engine exhaust valve through a rocker arm and a valve bridge of an engine, wherein the rocker arm or the valve bridge is provided with a braking piston and a hydraulic flow passage, and the braking piston is connected to the hydraulic flow passage, a valve lift reset mechanism is provided between the rocker arm and the valve bridge and includes a reset valve, and a reset flow passage located in the rocker arm or the valve bridge, wherein the process includes the following steps: placing the braking piston at an extended position by supplying pressure to the hydraulic flow passage, providing a reset valve between the rocker arm and the valve bridge, connecting the reset valve to a reset flow passage located in the rocker arm or the valve bridge, connecting the reset flow passage to the hydraulic flow passage, utilizing a change of a distance between the rocker arm and the valve bridge to open and close the reset valve, opening the reset valve when a valve lift of the engine exhaust valve enters into its top portion, releasing hydraulic pressure in the hydraulic flow passage through the reset flow passage, retracting the braking piston by a gap, eliminating a part of a motion transmission between the cam and the engine exhaust valve, reducing the valve lift of the engine exhaust valve, and during a returning process of the valve lift of the engine exhaust valve after passing its maximum position, closing the reset valve to resume pressure supply in the hydraulic flow passage, placing the braking piston at the extended position, and re-establishing the motion transmission between the cam and the engine exhaust valve.

Further, the cam is integrated with a braking cam and a conventional cam of the engine, and includes an enlarged conventional cam lobe and at least one braking cam lobe, the enlarged conventional cam lobe generates an enlarged conventional valve lift profile consisted of a bottom portion and a top portion, the bottom portion has approximately the same height as a braking valve lift profile generated by the at least one braking cam lobe, and the top portion is approximately the same as a conventional valve lift generated by a conventional cam lobe of the engine.

Further, the process of utilizing the motion of the cam to open the engine exhaust valve through the engine rocker arm and the valve bridge includes the following steps:

1) the reset valve having an oil-feeding position and an oil-draining position, and at the oil-feeding position, the reset valve closes the reset oil passage; and at the oil-draining position, the reset valve opens the reset oil passage, 2) turning on a brake control mechanism to supply oil to the hydraulic flow passage, 3) positioning the reset valve at the oil-feeding position, closing the reset oil passage, and the braking piston being located at the extended position, 4) rotating the cam from an inner base circle toward the at least one braking cam lobe, 5) transmitting a motion from the at least one braking cam lobe of the cam to at least one exhaust valve through the rocker arm, the valve bridge and the braking piston, 6) rotating the cam over a bottom portion of the enlarged conventional cam lobe and upward to a top portion of the enlarged conventional cam lobe, driving the rocker arm to rotate clockwise and the valve bridge to make a downward translational motion, changing the distance between the rocker arm and the valve bridge, changing the reset valve from the oil-feeding position to the oil-draining position due to the change of the distance between the rocker arm and the valve bridge, opening the reset oil passage to drain oil, moving the braking piston in the exhaust valve actuator from the extended position to the retracted position, a part of a motion from the top portion of the enlarged conventional cam lobe of the cam being lost, and resetting the enlarged conventional valve lift profile generated by the enlarged conventional cam lobe to a conventional valve lift profile generated by the conventional cam lobe of the engine, 7) rotating the cam over the highest position of the enlarged conventional cam lobe and downward to the bottom portion of the enlarged conventional cam lobe, driving the rocker arm to rotate anticlockwise and the valve bridge to make an upward translational motion, changing the distance between the rocker arm and the valve bridge in an opposite way as in step 6), moving the reset valve from the oil-draining position back to the oil-feeding position due to the opposite change of the distance between the rocker arm and the valve bridge, closing the reset oil passage again, moving the braking piston in the exhaust valve actuator from the retracted position back to the extended position, and transmitting the motion from the at least one braking cam lobe of the cam to the exhaust valve through the exhaust valve actuator and the braking piston, 8) returning the cam to the position as in step 6), and starting a next braking cycle until the brake control mechanism is turned off with oil being discharged from the hydraulic flow passage and an engine braking operation being turned off.

The present application also provides a valve lift reset device for an integrated engine brake, including a cam, a rocker arm and a valve bridge of an engine, the rocker arm or the valve bridge being provided with a braking piston and a hydraulic flow passage, the braking piston being connected to the hydraulic flow passage, wherein the cam is integrated with a braking cam and a conventional cam of the engine and includes an enlarged conventional cam lobe and at least one braking cam lobe, a valve lift reset mechanism is provided between the rocker arm and the valve bridge, the valve lift reset mechanism includes a reset valve and a reset oil passage, the reset oil passage is located in the rocker arm or in the valve bridge, the reset valve has an oil-feeding position and an oil-draining position, and at the oil-feeding position, the reset oil passage is closed by the reset valve; and at the oil-draining position, the reset oil passage is opened by the reset valve, and an action of the reset valve is coupled to a distance between the rocker arm and the valve bridge.

Further, the braking piston is integrated in the rocker arm.

Alternatively, the braking piston is integrated in the valve bridge.

Further, the reset valve is one of the following devices or a combination of two or more of the following devices:

a) a sliding-type plunger valve;

b) a lifting-type plunger valve;

c) a lifting-type ball valve;

d) a lifting-type column valve; and e) other devices being able to open and close the reset flow passage.

Further, the cam includes an enlarged conventional cam lobe and two braking cam lobes.

The working principle of the present application is as following. The cam, the rocker arm or the valve bridge form an exhaust valve actuator. When the engine braking is required, the engine brake control mechanism is turned on to supply a low pressure engine oil (the engine lubrication oil) to the brake actuation mechanism. The engine oil flows to the braking piston through a fluid network and a one-way valve so as to eliminate a gap formed by the braking piston in the exhaust valve actuator (in the rocker arm or in the valve bridge). At the same time, due to the oil pressure, the reset valve of the valve lift reset mechanism is placed at the oil-feeding position to close the reset oil passage. When the cam rotates to the braking cam lobe from the inner base circle, the motion from the braking cam lobe is transmitted to the exhaust valve through the exhaust valve actuator and the braking piston. The cam continues to rotate from the bottom portion to the top portion of the enlarged conventional cam lobe, so as to drive the rocker arm to rotate clockwise and the valve bridge to make a downward translational motion, thereby causing the change of the distance between the rocker arm and the valve bridge, which in turn changes the reset valve of the valve lift reset mechanism, provided between the rocker arm and the valve bridge, from the oil-feeding position to the oil-draining position. The reset oil passage is opened to drain oil, and the braking piston in the exhaust valve actuator is moved from the extended position to the retracted position, such that a part of the cam motion from the top portion of the enlarged conventional cam lobe is lost, and the enlarged conventional valve lift profile generated by the enlarged conventional cam lobe is reset to the conventional valve lift profile generated by the conventional engine cam lobe. When the cam rotates over the highest position of the enlarged conventional cam lobe and then moves downward to the bottom portion of the enlarged conventional cam lobe, the rocker arm rotates counterclockwise and the valve bridge makes an upward translational motion, thereby causing an opposite change of the distance between the rocker arm and the valve bridge. Such that, the reset valve of the valve lift reset mechanism between the rocker arm and the valve bridge is changed from the oil-draining position to the oil-feeding position, the reset oil passage is closed again, the braking piston in the exhaust valve actuator is moved from the retracted position to the extended position, and the motion of the braking cam lobe of the cam is transmitted to the exhaust valve through the exhaust valve actuator and the braking piston.

The above valve lift resetting process is completed in one braking cycle. The braking cycle repeats until the brake control mechanism is turned off. At this time, the brake control mechanism discharges oil (for a three-way solenoid valve) or ceases oil supply (for a two-way solenoid valve). The valve lift reset mechanism drains oil once in each engine cycle, and the oil drained is not supplemented, such that the gap in the valve actuation chain is formed again, and the motion of the braking cam lobe is skipped and will not be transmitted to the exhaust valve. The engine braking operation is turned off and the engine resumes its conventional operation state.

The present application has positive and significant effects over the prior art. The present application integrates the engine braking function, the valve lift resetting function and the conventional valve lifting function into the existing engine valve actuation chain, thereby forming a compact structure, reducing the weight and height of the engine, simplifying the engine braking device, and improving the safety and reliability of the engine operation.

DETAILED DESCRIPTION OF THE EMBODIMENTS

First Embodiment

Figure 1:
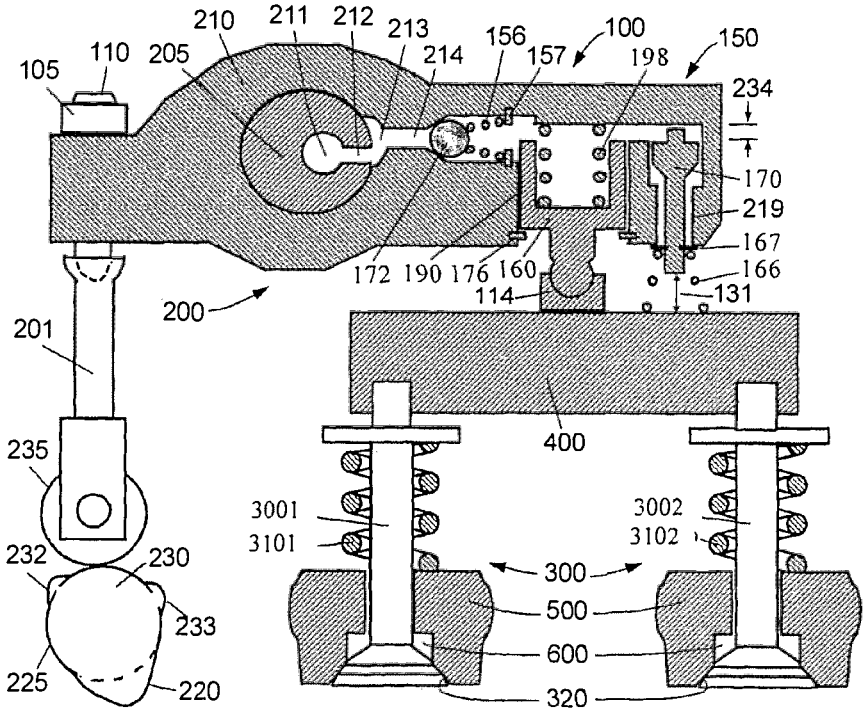
FIG. 1 is a schematic diagram showing a valve lift reset mechanism for an engine brake according to a first embodiment of the present application when the engine brake is at an "OFF" position.
Figure 2:
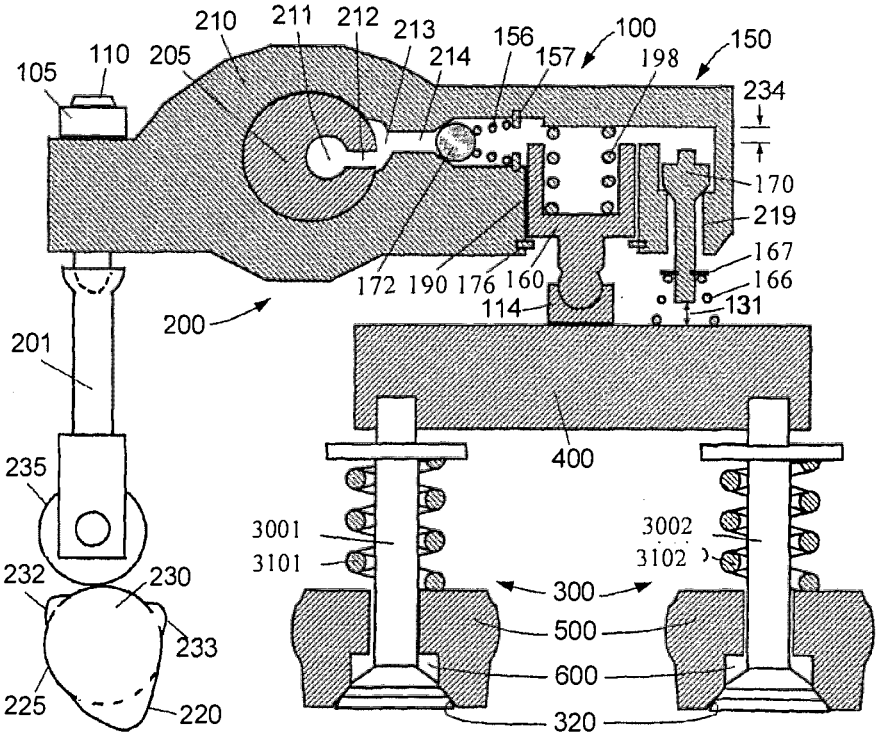
FIG. 2 is a schematic diagram showing the valve lift reset mechanism for an engine brake according to the first embodiment of the present application when the engine brake is at an "ON" position.

Reference is made to FIGS. 1 and 2, which are schematic diagrams showing a first embodiment of the present application when the engine brake is at the "OFF" and "ON" positions respectively. There are four main parts in FIGS. 1 and 2, including an exhaust valve actuator 200, an exhaust valve 300 (including an exhaust valve 3001 and an exhaust valve 3002), an engine brake actuation mechanism 100 and a valve lift reset mechanism 150.

The exhaust valve actuator 200 includes a cam 230, a cam follower 235, a push rod or a push tube 201 (overhead cam engine does not need the push rod or the push tube 201), a rocker arm 210 and a valve bridge 400 (an engine with one valve per cylinder does not need the valve bridge 400). Generally a valve lash adjusting system is arranged at one end of the rocker arm 210 (one end close to the valve bridge or one end close to the push rod). In the present embodiment, a valve lash adjusting screw 110 and the push rod 201 are connected to form the valve lash adjusting system, and the valve lash adjusting screw 110 is fixed to the rocker arm 210 by a lock nut 105. On an inner base circle 225, the cam 230 has an enlarged conventional cam lobe 220 which is mainly used for the conventional operation of the engine, and the reason that the enlarged conventional cam lobe 220 is larger than a conventional exhaust cam lobe (without an engine brake device) is because the braking cam is integrated with the conventional cam. Therefore, the integrated cam 230 is also provided with braking cam lobes 232 and 233 for the engine brake. A height of the braking cam lobes 232 and 233 is about 2 millimeters, which is far below the exhaust cam lobe. A bottom of the enlarged cam lobe 220 must have a transitional portion having about the same height as the braking cam lobes so as to skip the braking cam lobes 232 and 233 during the engine conventional operation (i.e. an ignition operation). A top portion of the enlarged cam lobe 220 is equivalent to the conventional exhaust cam lobe. The braking cam lobe 232 on the cam 230 is used for an Exhaust Gas Recirculation (EGR), and the braking cam lobe 233 is used for compression release. The rocker arm 210 is rotationally mounted on a rocker shaft 205, and a braking piston 160 is placed in a piston bore at an end, close to the valve bridge 400, of the rocker arm 210. The braking piston 160 is connected to an elephant foot pad 114 located at a central position of an upper surface of the valve bridge 400. The valve bridge 400 lies across the top of two exhaust valves 300.

The exhaust valve 3001 and the exhaust valve 3002 are biased onto valve seats 320 in an engine cylinder block 500 via a valve spring 3101 and a valve spring 3102 (the valve spring 3101 and the valve spring 3102 are collectively referred to as valve springs 310) respectively so as to prevent gas (being air during the engine braking) from flowing between an engine cylinder and an exhaust manifold 600. The exhaust valve actuator 200 transmits the mechanical motion of the cam 230 to the exhaust valves 300 via the valve bridge 400, so as to periodically open and close the exhaust valves 300.

The brake actuation mechanism 100 includes the braking piston 160, the braking piston 160 is slidably disposed in a piston bore 190 of the rocker arm 210 and is movable between an extended position and a retracted position (the position after resetting and oil draining). The braking piston 160 is biased onto a center position of the upper surface of the valve bridge 400 by a preload spring 198 located between the rocker arm 210 and the braking piston 160. A gap 234 is formed in the exhaust valve actuator 200 by the motion of the braking piston 160 between the retracted position and the extended position, such that the motion from a bottom portion of the cam 230 (including the braking cam lobes 232 and 233) will be skipped or lost during the conventional operation of the engine, and will not be transmitted to the exhaust valves 300. The brake actuation mechanism 100 further includes a one-way valve mechanism for supplying oil to the braking piston 160. The one-way valve mechanism includes a valve ball 172, a spring 156 and a spring seat 157.

A reset valve of the valve lift reset mechanism 150 is located between the rocker arm 210 and the valve bridge 400, and includes a reset piston 170 and a reset oil passage 219 which are both located in the rocker arm 210. A flow area of the reset oil passage 219 is much smaller than an oil inlet flow area. The reset piston 170 is movable between an oil-draining position and an oil-feeding position. In the oil-draining position, the reset valve is in an opened position, and in the oil-feeding position, the reset valve is in a closed position. During the conventional engine operation, the reset piston 170 is biased upward by a spring 166, and the reset valve is opened at the oil-draining position. One end of the spring 166 is on the valve bridge 400, and the other end thereof is on a spring seat 167 fixed to the reset piston 170. A preload force of the spring 166 is very small, which can keep the reset piston 170 in the rocker arm 210 without producing no-follow or impact.

Figure 3:
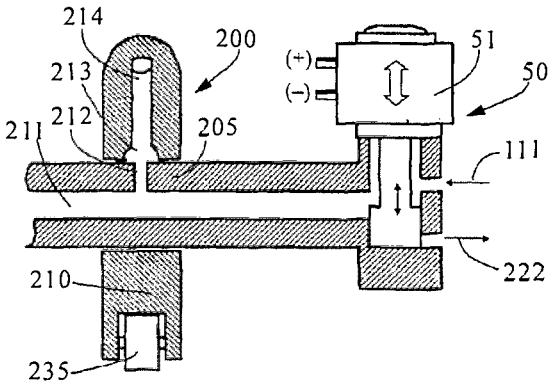
FIG. 3 is a schematic diagram showing a brake control mechanism at an "ON" position in the valve lift reset mechanism for an engine brake according to the present application.
Figure 5:
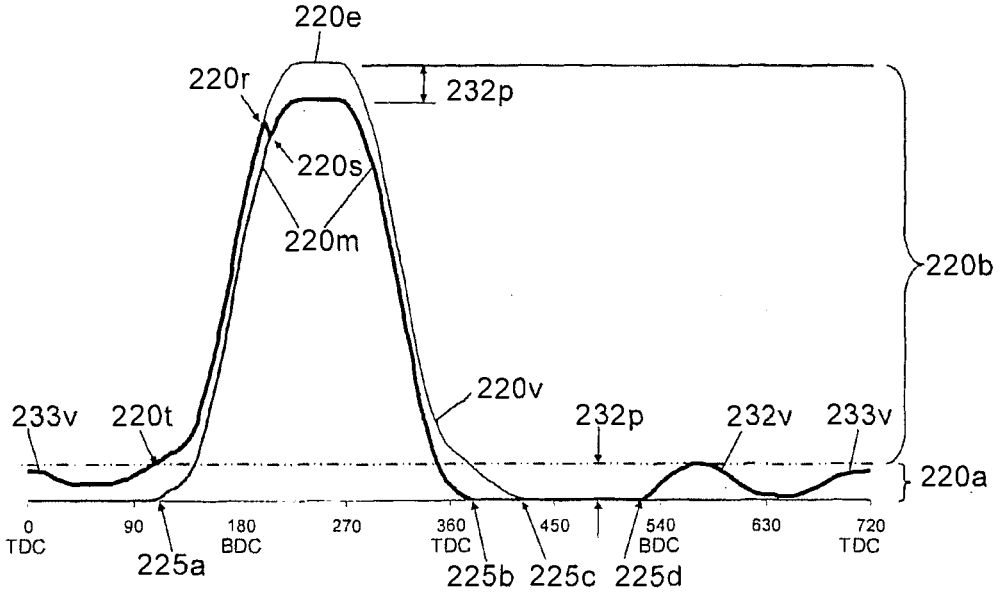
FIG. 5 is a schematic view of a conventional valve lift profile of an engine exhaust valve and an engine braking valve lift profile according to the present application.

As shown in FIG. 3, when the engine braking is required, the brake control mechanism is turned on, such that a solenoid valve 51 may supply oil to the brake actuation mechanism 100 through a brake fluid network. The oil pressure overcomes the force of the spring 156 and opens the one-way valve 172. The engine oil flows into the piston bore 190 and fills the gap 234 between the braking piston 160 and the rocker arm 210. At the same time, as shown in FIGS. 1 and 2, the oil pressure overcomes the force of the spring 166, and pushes the reset piston 170 from the oil-draining position to the oil-feeding position, thereby closing the reset oil passage 219. The engine oil forms a hydraulic linkage between the braking piston 160 and the rocker arm 210. When the cam 230 rotates from the inner base circle 225 to the braking cam lobes 232 and 233, the motion of the braking cam lobes is transmitted to the exhaust valves 300 through the exhaust valve actuator 200 (through the rocker arm 210 and the valve bridge 400) and the braking piston 160. The cam 230 continues to rotate from the bottom to the top of the enlarged conventional cam lobe 220, thereby driving the rocker arm 210 to rotate clockwise and the valve bridge 400 to make a downward translational motion, such that a distance between the rocker arm and the valve bridge is changed (other than a contact point of the elephant foot pad 114 and the valve bridge 400). A distance (a reset distance) 131 between the reset piston 170 in the rocker arm 210 and the valve bridge 400 is reduced. As shown in FIG. 5, when the motion of the enlarged conventional cam lobe 220 drives the valve bridge 400 and the exhaust valves 300 to move downward to the lowest position (i.e., the valve lift increases into a top portion, for example, at point 220*r* in FIG. 5), the valve bridge 400 acts on the reset piston 170 (the reset distance 131 becomes zero) to push it upward in the rocker arm 210, thereby changing the reset piston 170 from the oil-feeding position to the oil-draining position, then the reset valve is opened and the oil is drained from the reset oil passage 219. The braking piston 160 in the rocker arm 210 of the exhaust valve actuator 200 is moved from the extended position to the retracted position, a part of the motion from the top portion of the enlarged conventional cam lobe 220 of the cam 230 is lost, and an enlarged conventional valve lift profile 220*e* generated by the enlarged conventional cam lobe 220 is reset to a conventional valve lift profile 220*m* generated by the conventional cam lobe of the engine.

When the cam 230 rotates over the highest position of the enlarged conventional cam lobe 220 and rotates downward from the top to the bottom of the enlarged conventional cam lobe 220, the rocker arm 210 rotates counterclockwise, the valve bridge 400 makes an upward translational motion, and the reset distance 131 is increased. The reset piston 170 under the oil pressure moves downward relative to the rocker arm 210, and is back to the oil-feeding position from the oil-draining position, and the reset oil passage is closed again by the reset valve. The braking piston 160 in the rocker arm 210 returns to the extended position from the retracted position, and forms the hydraulic linkage again between the braking piston 160 and the rocker arm 210, so as to transmit the motion from the braking cam lobes 232 and 233 to the exhaust valves 300.

Figure 4:
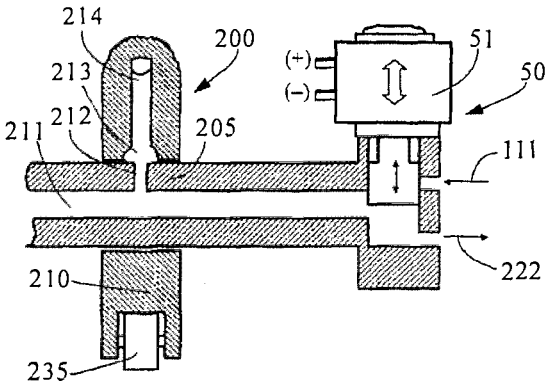
FIG. 4 is a schematic diagram showing the brake control mechanism at an "OFF" position in the valve lift reset mechanism for an engine brake according to the present application.

The above valve lift resetting process is completed in one braking cycle. The braking cycle repeats until the brake control mechanism 50 is turned off. As shown in FIG. 4, When the brake control mechanism 50 is turned off, the brake control mechanism 50 discharges oil (for a three-way solenoid valve 51) or ceases the oil supply (for a two-way solenoid valve). The valve lift reset mechanism 150 drains oil once in each engine cycle, the oil drained is not supplemented, then the hydraulic linkage between the braking piston 160 and the rocker arm 210 is eliminated, and the gap 234 in the valve actuation chain is formed again. Thus, the motion from the braking cam lobes 232 and 233 is skipped and will not be transmitted to the exhaust valves 300, the engine braking operation is turned off and the engine resumes its conventional operation state.

FIG. 3 and FIG. 4 are schematic diagrams of a brake control mechanism at the "ON" and "OFF" positions respectively for an engine brake according to the present application. Since the present application uses a valve lift reset mechanism 150, the two-position three-way solenoid valve 51 of the brake control mechanism 50 can be simplified to a two-way solenoid valve. In other words, only an oil intake hole 111 is needed, and an oil discharging hole 222 is not needed.

FIG. 5 is a schematic diagram of a conventional valve lift profile and an engine braking valve lift profile of a valve lift reset mechanism for an engine brake according to the present application. The exhaust valve lift profile further illustrates the operating process of the first embodiment. Three valve lift profiles are shown in the figure.

1. A conventional valve lift profile 220*m* for the engine's conventional (ignition) operation has a starting point 225*a*, an end point 225*b*, and a maximum height about 220*b*.

2. An enlarged valve lift profile 220V (including an enlarged conventional valve lift profile 220*e* and braking valve lift profiles 232*v* and 233*v*) for an engine braking operation without a valve lift reset mechanism has a starting point 225*d*, an end point 225*c*, and a maximum lift being the sum of

220*a* and 220*b*. The valve lift profile repeats itself between 0~720°, with 0° and 720° representing the same point.

3. A valve lift profile with resetting (indicated as the thick solid line in the figure) for an engine braking operation with a valve lift reset mechanism has a starting point 225*d*, an end point 225*b*, and the maximum lift 220*b*. Therefore, the valve lift profile with resetting closes earlier and has a lower lift than the enlarged valve lift profile 220*v*.

As shown in FIGS. 1 and 2, during the conventional operation of the engine, the bottom portion of the cam 230 (including the braking cam lobes 232 and 233) is skipped due to the gap 234 in the exhaust valve actuation chain, only the motion from the top portion of the enlarged conventional cam lobe 220 is transmitted to the valves 300, thereby producing the conventional valve lift profile 220*m* (see FIG. 5) which is the same as the conventional valve lift profile of an engine (without an engine brake). A bottom portion 220*a* and a top portion 220*b* of the enlarged conventional valve lift profile 220*e* generated by the enlarged conventional cam lobe 220 have a transition point 220*t*. A height 232*p* of the bottom portion 220*a* is the same as or slightly larger than the braking valve lifts 232*v* and 233*v* generated by the braking cam lobes 232 and 233, and the top portion 220*b* is substantially the same as the conventional valve lift profile 220*m*.

During the engine braking operation, the mechanical motion generated by the braking cam lobes 232 and 233 as well as the enlarged conventional cam lobe 220 can all be transmitted to the exhaust valves 300. However, the valve lift profile of the engine braking operation varies depending on the presence or absence of the valve lift reset mechanism 150. If there is an engine brake reset mechanism 150 (see FIGS. 1 and 2), the engine braking valve lift profile before a reset point 220*r* (which is between 220*t* and 220*e* and is higher than the braking valve lifts 232*v* and 233*v*) is the same as that without the reset mechanism (see FIG. 5). And after the reset point 220*r*, the valve is reset from the reset point 220*r* on the enlarged conventional valve lift profile 220*e* down to a point 220*s* on the conventional valve lift profile 220*m*, and finally returns to the valve seat at the end point 225*b* (i.e. the zero lift end point) which is far ahead of the end point 225*c* without the valve lift reset mechanism. Therefore, the valve lift reset mechanism 150 reduces the enlarged conventional valve lift profile 220*e* during its top portion to the conventional valve lift profile 220*m*. Thus, the valve lift is reduced at the top dead center of the engine piston at 360° to avoid the impact between the valve and the piston, which also increases the braking power and reduces the temperature in the cylinder.

Second Embodiment

Figure 6:
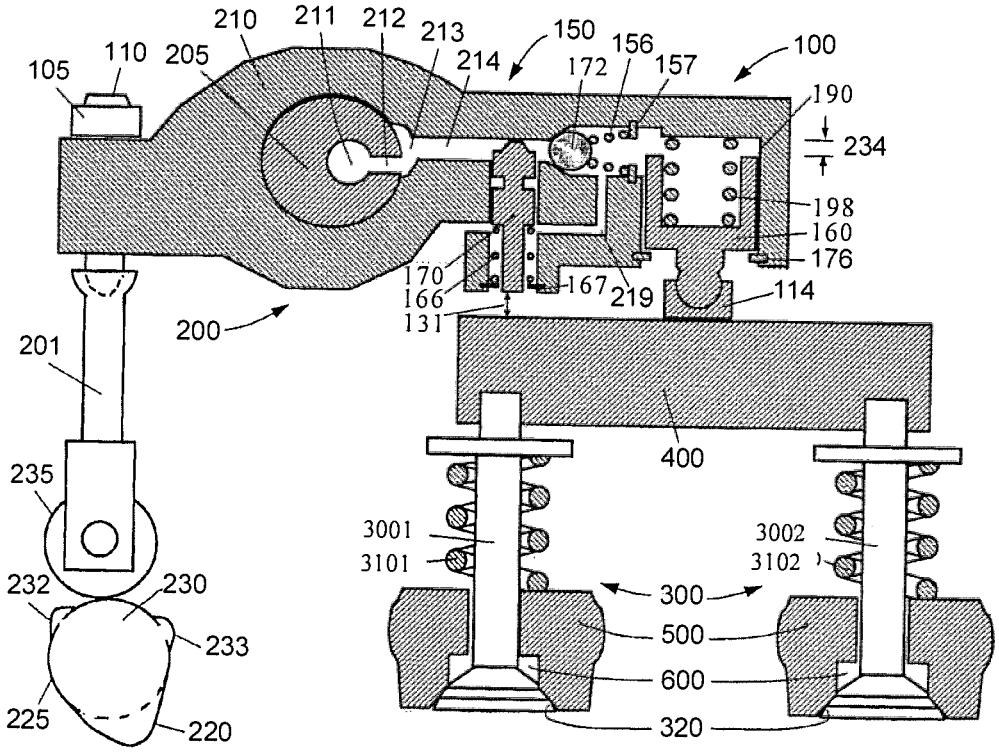
FIG. 6 is a schematic diagram showing a valve lift reset mechanism for an engine brake according to a second embodiment of the present application when the engine brake is at an "OFF" position.
Figure 7:
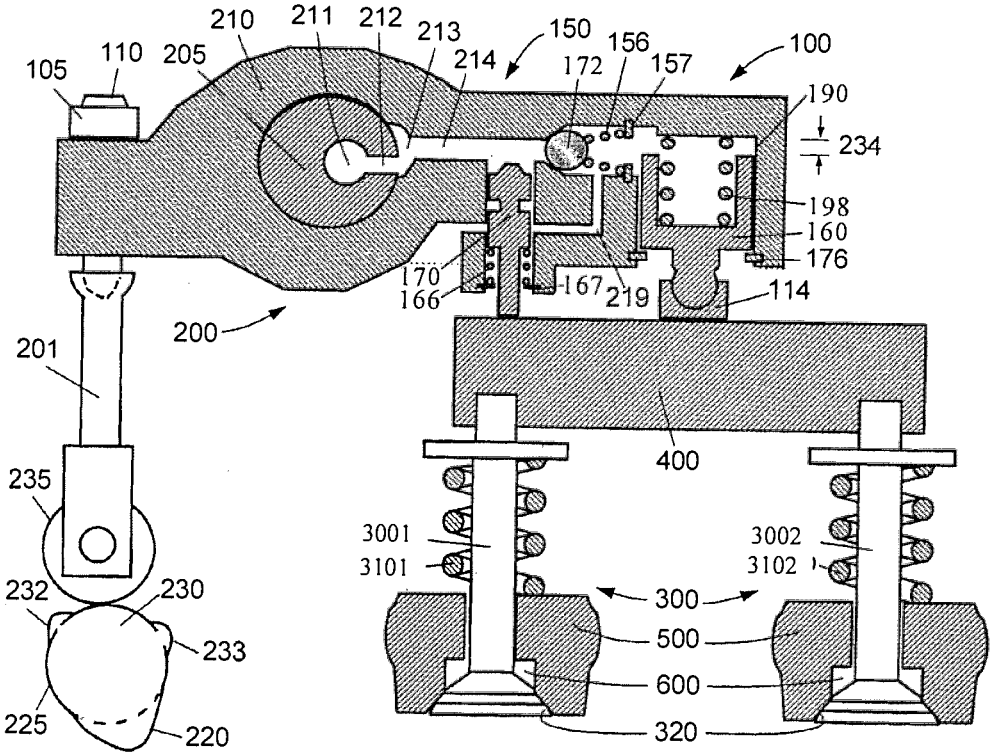
FIG. 7 is a schematic diagram showing the valve lift reset mechanism for an engine brake according to the second embodiment of the present application when the engine brake is at an "ON" position.

Reference is made to FIGS. 6 and 7, which are schematic diagrams showing a valve reset mechanism for an engine brake according to a second embodiment of the present application when the engine brake is at the "OFF" and "ON" positions respectively. The major difference between the present embodiment and the first embodiment is that the valve lift reset mechanism 150 in the rocker arm 210 is moved from an outer end close to the braking piston 160 to an inner end between the braking piston 160 and the rocker arm shaft 205. In addition, the reset valve is changed from a lifting-type plunger valve in the first embodiment to a sliding-type plunger valve in the present embodiment.

When the engine braking is required, the brake control mechanism is turned on and the solenoid valve 51 supplies oil to the brake actuation mechanism 100 through the brake fluid network. Oil pressure overcomes the force of the spring 166 and pushes the reset piston 170 downward from the oil-draining position to the oil-feeding position to close the reset oil passage 219. At this time, the valve bridge 400 acts on the reset piston 170 to prevent the reset piston 170 from moving down further in the rocker arm 210. At the same time, the oil pressure overcomes the force of the spring 156 and opens the one-way valve 172. Engine oil flows into the piston bore 190 and fills the gap 234 between the braking piston 160 and the rocker arm 210 to form a hydraulic linkage between the braking piston 160 and the rocker arm 210. When the cam 230 rotates from the inner base circle 225 to the braking cam lobes 232 and 233, the motion of the braking cam lobes 232 and 233 is transmitted to the exhaust valves 300 through the exhaust valve actuator 200 (through the rocker arm 210 and the valve bridge 400) and the braking piston 160. The cam 230 rotates over the bottom of the enlarged conventional cam lobe 220, and then moves upward to the top of the enlarged conventional cam lobe 220, so as to drive the rocker arm 210 to rotate clockwise and the valve bridge 400 to make a downward translational motion, thereby changing the distance between the rocker arm and the valve bridge (except for the contact point of the elephant foot pad 114 and the valve bridge 400). The distance (the reset distance) 131 between the reset piston 170 in the rocker arm 210 and the valve bridge 400 is increased. When the motion of the enlarged conventional cam lobe 220 causes the valve bridge 400 and the exhaust valves 300 to move downward to the lowest position (i.e., the valve lift increases and enters into the top, for example, at the point 220*r* in FIG. 5), the reset piston 170 moves downward with the valve bridge 400, such that the reset valve in the rocker arm 210 is changed to the oil-draining position, and the reset oil passage 219 is opened to drain oil. The braking piston 160 in the rocker arm 210 of the exhaust valve actuator 200 is moved from the extended position to the retracted position, and a part of the motion from the top portion of the enlarged conventional cam lobe 220 of the cam 230 is lost, thus the enlarged conventional valve lift profile 220*e* generated by the enlarged conventional cam lobe 220 is reset and reduced to the conventional valve lift profile 220*m* generated by the conventional cam lobe of the engine.

When the cam 230 rotates over the highest position of the enlarged conventional cam lobe 220, and moves downward from the top to the bottom of the enlarged conventional cam lobe 220, the rocker arm 210 rotates counterclockwise, and the valve bridge 400 makes an upward translational motion, thus the reset distance 131 is reduced. Under the action of the valve bridge 400, the reset piston 170 is moved upward relative to the rocker arm 210, and then the reset oil passage is closed again by the reset valve. The braking piston 160 in the rocker arm 210 is moved from the retracted position to the extended position, and the hydraulic linkage between the braking piston 160 and the rocker arm 210 is re-established, such that the motion from the braking cam lobes 232 and 233 is transmitted to the exhaust valves 300.

The above valve lift resetting process is completed in one braking cycle. The braking cycle repeats until the brake control mechanism 50 is turned off. At this time, the brake control mechanism 50 discharges oil (for a three-way solenoid valve 51) or ceases the oil supply (for a two-way solenoid valve). The valve lift reset mechanism 150 drains oil once in each engine cycle, and the oil drained is not supplemented, such that the hydraulic linkage between the braking piston 160 and the rocker arm 210 is eliminated, and the gap 234 in the valve actuation chain is formed again. Thus, the motion from the braking cam lobes 232 and 233 is skipped and will not be transmitted to the exhaust valves 300, and the engine braking operation is turned off and the engine resumes its conventional operation state.

Third Embodiment

Figure 8:
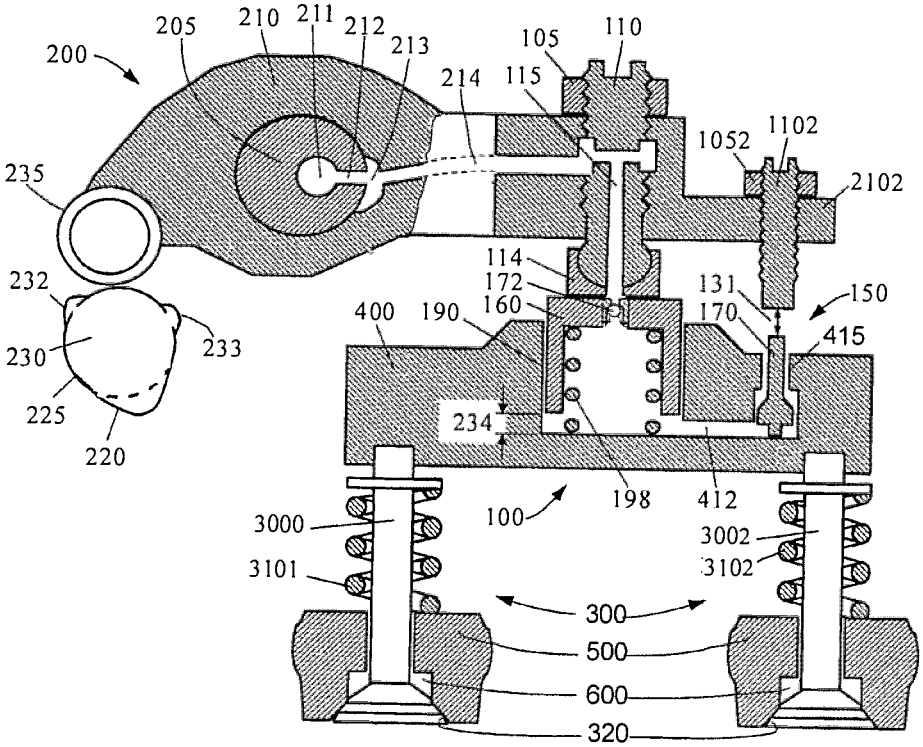
FIG. 8 is a schematic diagram showing a valve lift reset mechanism for an engine brake according to a third embodiment of the present application when the engine brake is at an "OFF" position.
Figure 9:
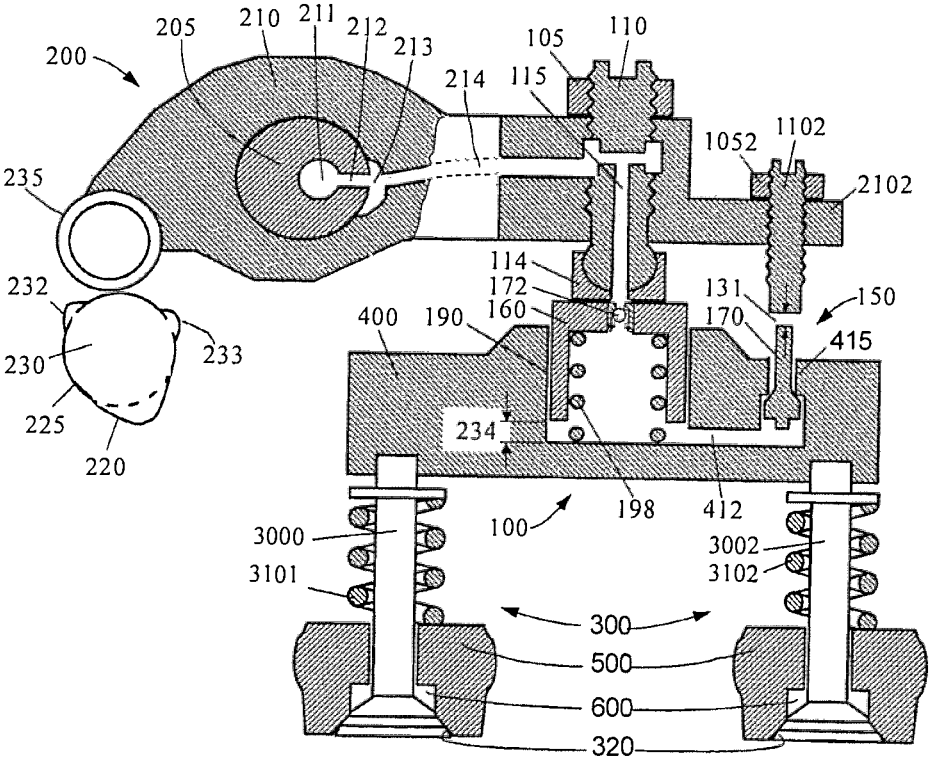
FIG. 9 is a schematic diagram showing the valve lift reset mechanism for an engine brake according to the third embodiment of the present application when the engine brake is at an "ON" position.

Reference is made to FIGS. 8 and 9, which are schematic diagrams showing a valve reset mechanism according to a third embodiment of the present application when the engine brake is at the "OFF" and "ON" positions respectively. An overhead cam engine is provided in the present application, thus there is no push rod or push tube, and the exhaust valve lash adjusting screw 110 is mounted on a side close to the valve bridge 400. The brake actuation mechanism 100 is integrated in the valve bridge 400. The braking piston 160 is placed in a piston bore 190 which is an upward opening in the center of the valve bridge 400. A preload spring 198 provided between the braking piston 160 and the valve bridge 400 biases the braking piston 160 upward against the elephant foot pad 114. A one-way valve 172 is placed in the braking piston 160.

A reset valve of the valve lift reset mechanism 150 is also located between the rocker arm 210 and the valve bridge 400, and includes a reset piston 170 and a reset oil passage 415 which are both located in the valve bridge 400. A flow area of the reset oil passage 415 is much smaller than the oil inlet flow area. The reset piston 170 is movable between an oil-draining position and an oil-feeding position. At the oil-draining position (see FIG. 8), the reset piston 170 is moved downward to open the reset oil passage 415, and the oil is discharged through a high pressure oil passage 412; and at the oil-feeding position (see FIG. 9), the reset piston 170 is moved upward under the oil pressure to close the reset oil passage 415.

The valve lift reset mechanism 150 further includes an adjusting screw 1102 fixed by a nut 1052 onto a projecting portion 2102 of the rocker arm 210. The projecting portion 2102 can also be a separate part fastened on the rocker arm 210. The adjusting screw 1102 is located above the reset piston 170 for adjusting a reset distance 1312 between the adjusting screw 1102 and the reset piston 170. The reset distance 1312 is designed, so that when the reset piston 170 is at the oil-draining position (see FIG. 8), the reset piston 170 does not contact the adjusting screw 1102 in the entire rotation period of the cam 230. In this way, the operating frequency of the valve lift reset mechanism 150 is greatly reduced, thereby increasing its reliability and durability.

When the engine braking is required, the brake control mechanism is turned on. The solenoid valve 51 supplies oil to the brake actuation mechanism 100 through a brake fluid network (see FIGS. 8 and 9). The oil flows through the one-way valve 172 and into the piston bore 190, and the braking piston in the valve bridge 400 is at the extended position. At the same time, oil pressure pushes the reset piston 170 from the oil-draining position (see FIG. 8) upward to the oil-feeding position (see FIG. 9) to close the reset oil passage 415, and a hydraulic linkage is formed between the braking piston 160 and the valve bridge 400 by the engine oil. When the cam 230 rotates from the inner base circle 225 to the braking cam lobes 232 and 233, the motion of the braking cam lobes is transmitted to the exhaust valves 300 through the exhaust valve actuator 200 (through the rocker arm 210 and the valve bridge 400) and the braking piston 160. When the cam 230 rotates over the bottom portion of the enlarged conventional cam lobe 220 and continues to rotate upward to the top portion of the enlarged conventional cam lobe 220, the reset piston 170 makes a downward translational motion along with the valve bridge 400, while the adjusting screw 1102 rotates clockwise along with the rocker arm 210, and the reset distance 1312 between the adjusting screw 1102 and the reset piston 170 is reduced. When the enlarged cam lobe 220 of the cam 230 pushes the valve bridge 400 and the exhaust valves 300 downward to the lowest position (i.e., the valve lift is increased and enters into the top portion, for example, at point 220*r* in FIG. 5), the adjusting screw 1102 pushes the reset piston 170 downward, and the reset valve is changed from the oil-feeding position to the oil-draining position, and the reset oil passage 415 is opened to discharge oil. The braking piston 160 in the valve bridge 400 of the exhaust valve actuator 200 is moved from the extended position to the retracted position. A part of the motion from the top portion of the enlarged conventional cam lobe 220 of cam 230 is lost, and the enlarged conventional valve lift profile 220*e* generated by the enlarged conventional cam lobe 220 is reset and reduced to the conventional valve lift profile 220*m* generated by the conventional cam lobe of the engine.

Once the cam 230 rotates over the highest position of the enlarged cam lobe 220 and moves downward from the top portion to the bottom portion of the enlarged cam lobe 220, the rocker arm 210 rotates counterclockwise, and the adjusting screw 1102 moves upwards along with the rocker arm 210. The valve bridge 400 also makes an upward translational motion, and the reset distance 1312 is increased. The reset piston 170 in the valve bridge 400 moves upward under oil pressure and returns to the oil-feeding position from the oil-draining position, such that the reset oil passage is closed again. The braking piston 160 in the valve bridge 400 returns to the extended position from the retracted position, and the hydraulic linkage between the braking piston 160 and the valve bridge 400 is re-established, such that the motion from the braking cam lobes 232 and 233 is transmitted to the exhaust valves 300.

The above valve lift resetting process is completed in one braking cycle. The braking cycle repeats until the brake control mechanism 50 is turned off. At this time, the brake control mechanism 50 discharges oil (for a three-way solenoid valve 51) or ceases the oil supply (for a two-way solenoid valve). The valve lift reset mechanism 150 drains oil once in each engine cycle, and the oil drained is not supplemented, such that the hydraulic linkage between the braking piston 160 and the valve bridge 400 is eliminated, and the gap 234 in the valve actuation chain is formed again. Thus, the motion from the braking cam lobes 232 and 233 is skipped and will not be transmitted to the exhaust valves 300, and the engine braking operation is turned off and the engine resumes its conventional operation state.

Fourth Embodiment

Figure 10:
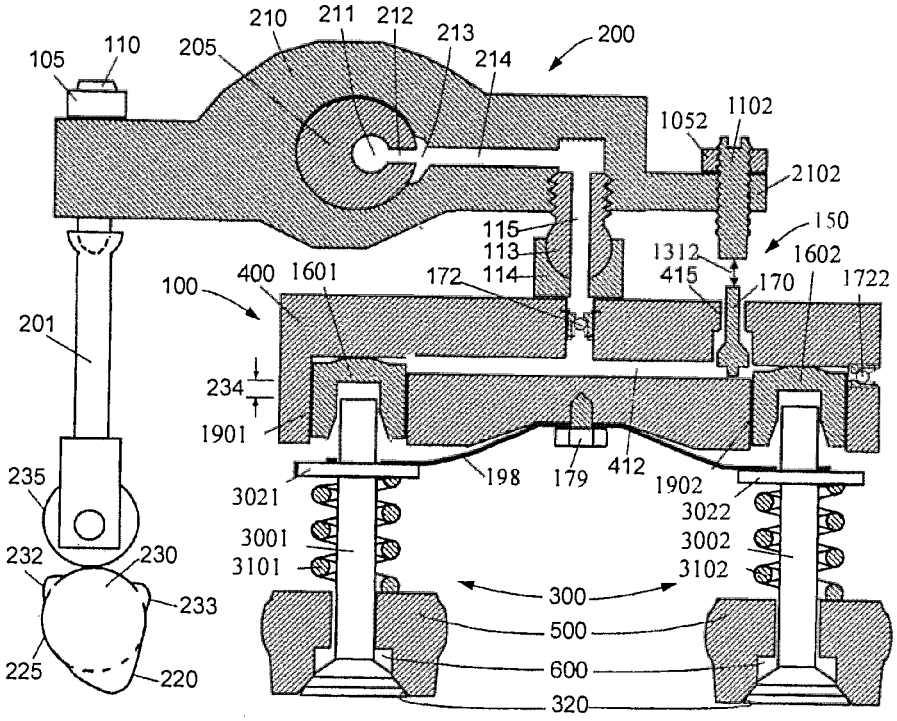
FIG. 10 is a schematic diagram showing a valve lift reset mechanism for an engine brake according to a fourth embodiment of the present application when the engine brake is at an "OFF" position.
Figure 11:
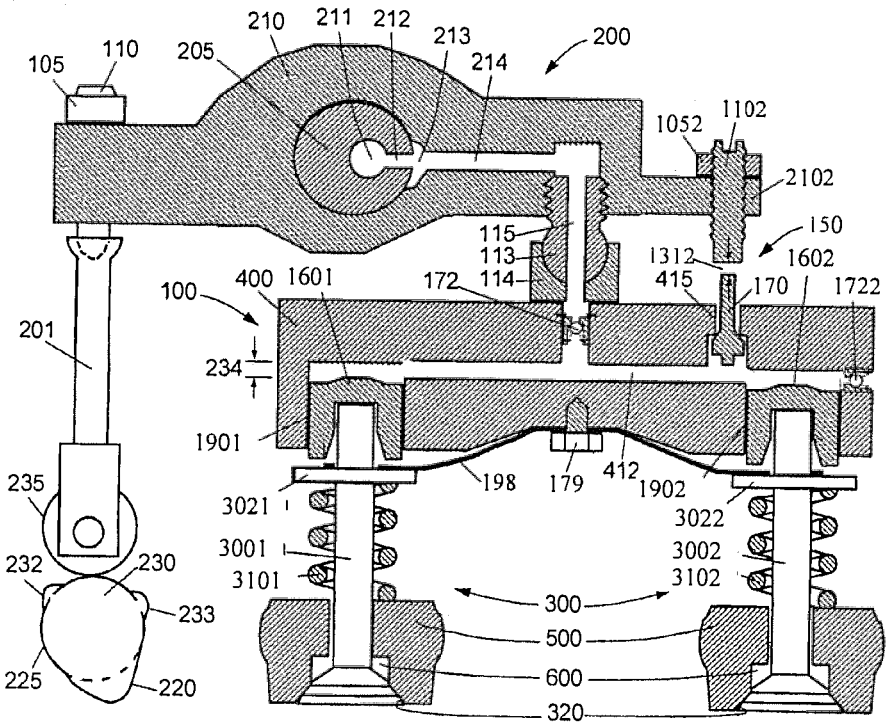
FIG. 11 is a schematic diagram showing the valve lift reset mechanism for an engine brake according to the fourth embodiment of the present application when the engine brake is at an "ON" position.

Reference is made to FIGS. 10 and 11, which are schematic diagrams showing a valve lift reset mechanism according to a fourth embodiment of the present application when an engine brake is at the "OFF" and "ON" positions respectively. The braking actuation mechanism 100 includes a braking piston 1601 and a braking piston 1602 (referred to as braking pistons 160) which are slidably disposed in a piston bore 1901 and a piston bore 1902 (referred to as piston bores 190) respectively in the valve bridge 400 and are movable between a non-operating position (see FIG. 10) and an operating position (see FIG. 11). The non-operating position and the operating position form a gap 234 in the exhaust valve actuation chain (between the valve bridge 400 and the valves 300) for skipping the motion from the bottom portion of the cam 230 (including small cam lobes 232 and 233) during the conventional operation of the engine.

A preload spring 198 for an anti-impact mechanism is a leaf spring placed between the valve bridge 400 and the valves 300 and biases the valve bridge 400 upward against the rocker arm 210 (against the elephant foot pad 114). A middle of the preload spring 198 is fixed on the valve bridge 400 by a screw 179, and two ends of the preload spring 198 are respectively located on valve spring retaining rings 3021 and 3022 fixed onto two valve stems. The braking pistons 160 are not subjected to any force of the preload spring 198. The design of the preload spring 198 only needs to consider the rotational inertia of the valve actuation chain or no-follow, and the spring preload force does not limited to the actuation oil pressure of the braking pistons 160. Therefore, the anti-impact mechanism of the present application can maintain the gap 234 in the valve actuation chain so as to prevent no-follow or impact in the valve actuation chain without impeding the actuation of the brake actuation mechanism 100.

Fifth Embodiment

Figure 12:
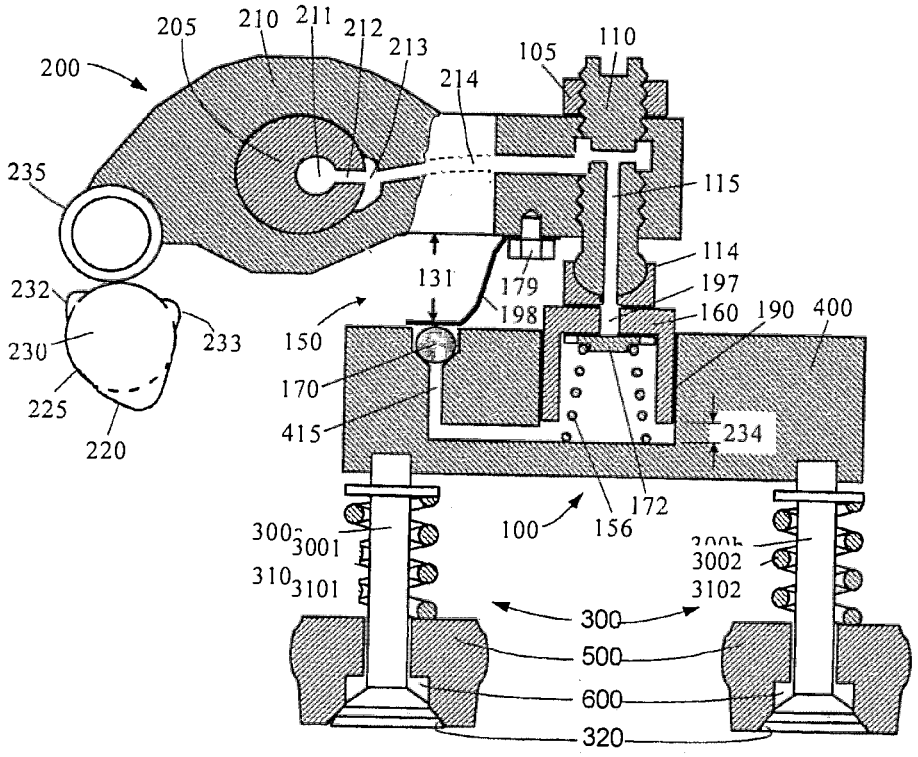
FIG. 12 is a schematic diagram showing a valve lift reset mechanism for an engine brake according to a fifth embodiment of the present application when the engine brake is at an "OFF" position.

As shown in FIG. 12, in a valve lift reset mechanism according to a fifth embodiment of the present application, the anti-impact mechanism, the valve lift reset mechanism 150 and the overload pressure relief mechanism are integrated together. The preload spring 198 (which is shown as the leaf spring, and can also be a coil type or other spring) of the anti-impact mechanism is placed between the rocker arm 210 and the valve bridge 400, with one end being fixed to the rocker arm 210 by a screw 179 and the other end being pressed on a pressure relief valve ball 170 of a pressure relief valve. The preload spring 198 is used to maintain the gap 234 in the valve actuation chain so as to prevent no-follow and impact in the valve actuation chain. The preload spring 198 of the anti-impact mechanism is also a pressure relief spring for the overload pressure relief mechanism, and the pressure relief valve ball 170 of the overload relief mechanism is also a reset valve ball for the valve lift reset mechanism 150.

When the engine braking is required, the brake control mechanism is turned on (see FIG. 3). The solenoid valve 51 supplies oil to the brake actuation mechanism 100 through a brake fluid network (see FIG. 12). Oil pressure overcomes the preload force of the spring 156 and opens the one-way valve 172. The oil flows into the braking piston bore 190 and a hydraulic linkage is formed between the braking piston 160 and the valve bridge 400 by the engine oil. When the cam 230 rotates, the whole motion of the cam 230, including the motion of the small braking cam lobes 232 and 233, can be transmitted to the exhaust valves 300 through the hydraulic linkage to produce the engine braking.

When the load acting on the braking piston 160, i.e. a braking oil pressure, exceeds a predetermined value, the oil pressure force on the pressure relief valve ball (also the reset valve ball) 170 will exceed the preload force of the pressure relief spring (also the preload spring) 198, and pushes the pressure relief valve ball 170 upward and out of the valve seat, such that a pressure relief oil passage (also a reset oil passage) is opened to discharge oil and reduce the oil pressure, thereby ensuring that the load on the braking piston will not exceed the predetermined value.

The working process of the valve lift reset mechanism 150 according to the present embodiment is also different. When the cam 230 rotates, the reset valve ball (also the pressure relief valve ball) 170 makes a downward translational motion along with the valve bridge 400, and the preload spring 198 fixed on the rocker arm 210 rotates with the rocker arm 210, such that a distance between the preload spring 198 and the reset valve ball 170 is increased. When the valve bridge 400 and the exhaust valves 300 pushed downward by the enlarged cam lobe 220 of the cam 230 approach the lowest position (i.e., the valve lift approaches to the peak lift, for example at the reset point 220*r* in FIG. 5), the preload spring 198 will leave the reset valve ball 170, and then the reset valve ball 170 moves upward and is out of the valve seat to open the reset oil passage 415 to discharge oil. The braking piston 160 in the valve bridge 400 returns to the retracted position from the extended position, thereby eliminating the hydraulic linkage between the braking piston 160 and the valve bridge 400, such that the enlarged main valve lift profile 220*v* generated by the enlarged conventional cam lobe is reset and reduced to the conventional valve lift profile 220*m* generated by the conventional engine cam lobe (see FIG. 5).

Once the cam 230 rotates over the highest point of the enlarged cam lobe 220, the rocker arm 210 begins to rotate counterclockwise and the preload spring 198 moves upward along with the rocker arm 210, and the valve bridge 400 also makes an upward translational motion, thus the distance between the valve bridge 400 and the preload spring 198 is reduced. The preload spring 198 pushes the reset valve ball 170 back to the valve seat, thereby closing the reset oil passage 415. Oil flows into the braking piston bore 190 via the one-way valve 172, and the braking piston 160 in the valve bridge 400 returns to the extended position from the retracted position, such that a hydraulic linkage is formed between the braking piston 160 and the valve bridge 400, and the motion from the small braking cam lobes 232 and 233 is completely transmitted to the exhaust valves 300. Such braking cycle is repeated until the brake control mechanism 50 is turned off (see FIG. 4).

Sixth Embodiment

Figure 13:
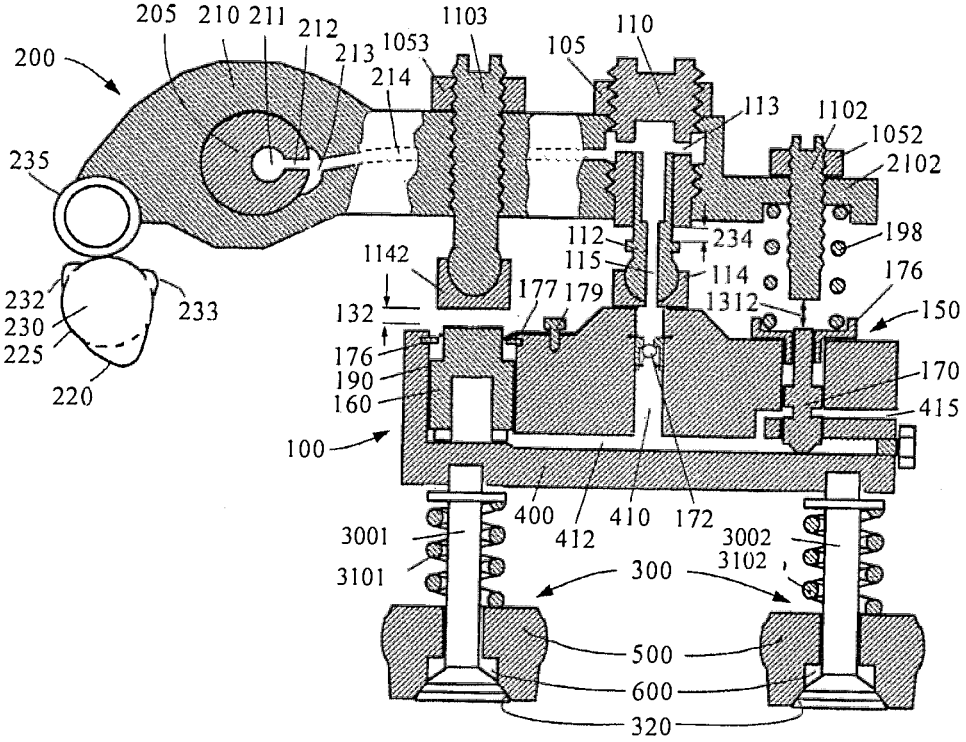
FIG. 13 is a schematic diagram showing a valve lift reset mechanism for an engine brake according to a sixth embodiment of the present application when the engine brake is at an "OFF" position.
Figure 14:
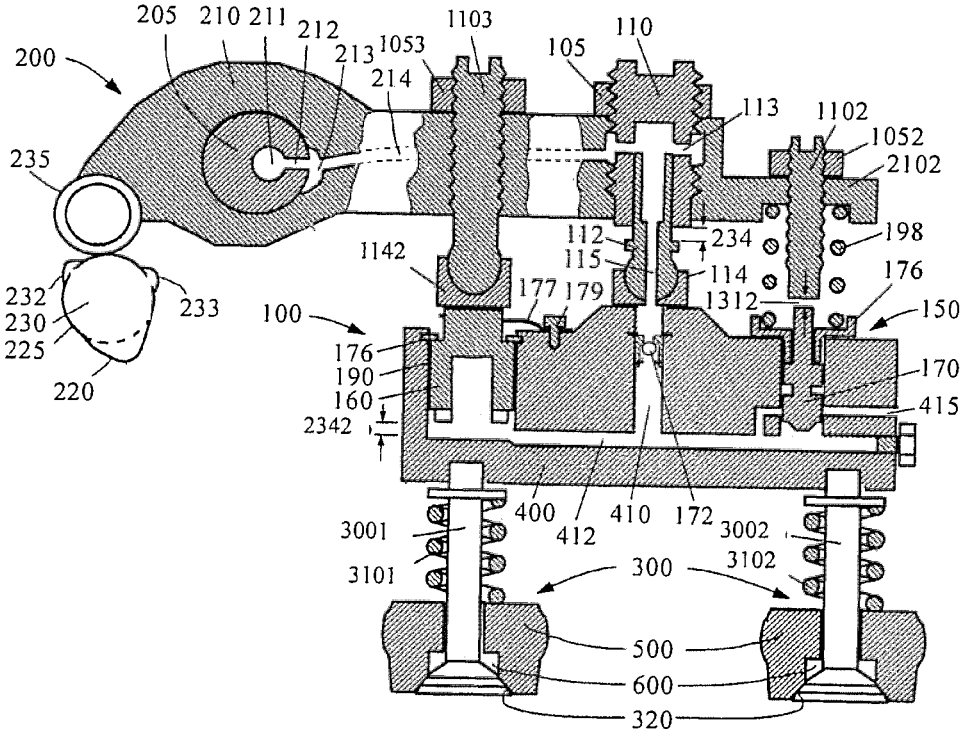
FIG. 14 is a schematic diagram showing the valve lift reset mechanism for an engine brake according to the sixth embodiment of the present application when the engine brake is at an "ON" position.

Reference is made to FIGS. 13 and 14, which are schematic diagrams showing a valve reset mechanism according to a sixth embodiment of the present application when an engine brake is at the "OFF" and "ON" positions respectively. During the engine braking of the present application, the motion of the braking cam is only transmitted to one exhaust valve 3001 at a side next to the rocker arm shaft 205. The braking piston 160 of the brake actuation mechanism 100 is placed in a piston bore at a left end of the valve bridge 400 and is slidable between a non-operating position (see FIG. 13) and an operating position (see FIG. 14). The non-operating position and the operating position form a gap 2342 (see FIG. 10) between the braking piston 160 and the valve bridge 400, and at the same time, a gap 234 is also required to be formed inside the valve actuation chain. The braking piston 160 is generally biased downward at the non-operating position in the valve bridge by a brake spring 177 fixed on the valve bridge 400 (see FIG. 13). The stroke of the braking piston 160 is limited by a snap ring 176. The lash 132 of the braking exhaust valve 3001 (see FIG. 13) is controlled by a braking valve lash adjusting screw 1103 which is fastened on the rocker arm 210 by a nut 1053. A braking elephant foot pad 1142 is provided under the adjusting screw, and acts on the braking piston 160. The one-way valve 172 is located in an oil passage 410 in the valve bridge 400.

The preload spring 198 of the anti-impact mechanism is placed between the rocker arm 210 and the valve bridge 400, with an upper end abutting against the rocker arm 210 and a lower end located on a spring seat 176 on the valve bridge 400. The spring seat 176 also acts as a stopper to limit the stroke of the reset piston 170. The preload spring 198 is used to maintain the gap 234 in the valve actuation chain so as to prevent no-follow and impact in the valve actuation chain. Herein, the preload spring 198 of the anti-impact mechanism is also a pressure relief spring for the overload pressure relief mechanism, and the pressure relief piston 170 of the overload pressure relief mechanism is also a reset piston for the valve lift reset mechanism 150.

When the engine braking is required, the brake control mechanism (see FIG. 3) is turned on. The solenoid valve 51 supplies oil to the brake actuation mechanism 100 through the brake fluid network (see FIG. 13). Oil flows into a high-pressure oil passage 412 through the one-way valve 172. Oil pressure pushes the reset piston (also the pressure relief piston) 170 upward to the oil-feeding position (see FIG. 14) from the oil-draining position (see FIG. 13), thereby closing the valve lift reset oil passage 415. At the same time, the oil pressure overcomes the force of the brake spring 177 and pushes the braking piston 160 upward to the operating position (see FIG. 14) from the non-operating position (see FIG. 13), such that a hydraulic linkage is formed between the braking piston 160 and the valve bridge 400 by the engine oil. When the cam 230 rotates, the whole motion of the cam 230, including the motion of the small braking cam lobes 232 and 233, can be transmitted to the exhaust valves 3001 through the hydraulic linkage, thereby producing the engine braking.

When the load acting on the braking piston 160, that is the braking oil pressure, exceeds a predetermined value, the oil pressure force on the pressure relief piston (also the reset piston) 170 will exceed the preload force of the pressure relief spring (also the preload spring) 198, so as to further push the pressure relief piston 170 upward (the spring seat 176 is also pushed upward) and open the pressure relief oil passage (also the reset oil passage) 415 to discharge oil and reduce pressure. In this way, the load acting on the braking piston will not exceed the predetermined value.

The working principle of the valve lift reset mechanism 150 according to the present embodiment is different. When the cam 230 rotates, the rocker arm 210 rotates clockwise and the valve bridge 400 makes a downward translation motion. A distance between the rocker arm 210 and the valve bridge 400 is increased at an end close to the rocker arm shaft 205, for example at the position of the brake adjusting screw 1103, however the distance between the rocker arm 210 and the valve bridge 400 is reduced at an end far away from the rocker arm shaft 205, for example at the position of the reset adjusting screw 1102.

When the enlarged cam lobe 220 of the cam 230 pushes the valve bridge 400 and the exhaust valves 300 downward and enters the top portion of the valve lift profile (**220*b* in FIG. 5), a rod with a spherical head 112 in the exhaust valve lash adjusting screw 110 moves upward to eliminate the gap 234 and close an oil supply passage 113. The motion of the enlarged cam lobe 220 is transmitted to the two valves 300 through the rocker arm 210, the rod with a spherical head 112 and the valve bridge 400. At the same time, a reset distance 1312 between the reset adjusting screw 1102 and the reset piston 170 is reduced. The adjusting screw 1102 pushes the reset piston 170 downward to open the reset oil passage 415 to discharge oil. Without oil pressure, the braking piston 160 is moved downward under the action of the brake spring 177 from the operating position to the non-operating position, and the hydraulic linkage between the braking piston 160 and the valve bridge 400 is temporarily eliminated, and will be re-established when the exhaust valves 300 return to the bottom portion of the valve lift profile (i.e. 220*a* in FIG. 5, the above process can be referred to the following detailed description). Accordingly, during the process of moving downward till onto the valve seat, the braking exhaust valve 3001 is not subjected to the action of the brake actuation mechanism 100 (the braking piston 160), and the valve lift profile of the braking exhaust valve 3001 is reset from 220*v* to the conventional valve lift profile 220*m*, with the closing timing (220*b* in FIG. 5**) being advanced and the valve lift at the top dead point being reduced.

When the cam 230 rotates over the highest point of the enlarged cam lobe 220, the rocker arm 210 begins to rotate counterclockwise, the reset adjusting screw 1102 moves upward along with the rocker arm 210, and the valve bridge 400 also makes an upward translational motion. Thus, the reset distance 1312 between the reset adjusting screw 1102 and the reset piston 170 is increased. When the exhaust valves 300 moves upward into the bottom portion of the valve lift profile (**220*a* in FIG. 5) and is close to the valve seat, the rod with a spherical head 112 in the exhaust valve lash adjusting screw 110 (due to the oil pressure, a spring could be added if needed) moves downward, thereby generating the gap 234 and re-opening the oil supply passage 113. Oil flows into the high-pressure oil passage 412 through the one-way valve 172. Oil pressure pushes the reset piston 170 upward back to the oil-feeding position (see FIG. 14) from the oil-draining position (see FIG. 13), thereby closing the valve lift reset oil passage 415. At the same time, the oil pressure overcomes the force of the brake spring 177 and pushes the braking piston 160 upward back to the operating position (see FIG. 14) from the non-operating position (see FIG. 13). The hydraulic linkage is re-established between the braking piston 160 and the valve bridge 400 by the engine oil. The whole recovery process is completed during a period between 225*b* and 225*d* in FIG. 5. Therefore, the motion from the small braking cam lobes 232 and 233 can be completely transmitted to the exhaust valve 3001. The above braking cycle is repeated until the brake control mechanism 50 is turned off (see FIG. 4**).

The above description discloses a valve lift reset apparatus and method for the engine braking. The working principle is to change the position of the reset valve between the rocker arm and the valve bridge through the change of the distance between the rocker arm and the valve bridge, and to reset the braking valve lift in each engine braking cycle. The above various embodiments should not be regarded as limiting the scope of the present application, but rather as specific exemplifications representing the present application. Many other variations are likely to be derived from the above embodiments. For example, the engine brake can be an integrated rocker arm brake or an integrated valve bridge brake; there can be one braking piston or more braking pistons, such as dual braking pistons in the valve bridge; and during the engine braking, one exhaust valve can be opened, or more exhaust valves can be opened, such as a double-valve braking.

In addition, for the compression release type engine brake and the bleeder type engine brake, the reset positions of the exhaust valve lift are both at the top portion of the valve lift, that is, a portion above the braking valve lift.

Also, the reset valve of the valve lift reset mechanism can have different forms, including a lifting-type plunger valve or a sliding-type plunger valve both formed by a reset piston, a lifting-type ball valve or a lifting-type column valve both formed by a reset valve ball, as well as other mechanisms having functions of opening and closing the reset flow passage. These reset valves are interchangeable as needed.

In addition, the load bearing mode of the engine brake can be hydraulic (a hydraulic linkage to support the braking load) or mechanical (a mechanical linkage to support the braking load).

Also, the preload spring 198 can be installed at different positions, for example, between the braking piston and the rocker arm, or between the braking piston and the valve bridge, or between the rocker arm and the valve bridge, or between the rocker arm and the engine, or between the valve bridge and the exhaust valve, etc. The preload spring 198 can also adopt different forms, such as a leaf spring. The function of the preload spring 198 is to ensure that no-follow or impact will not occur in the exhaust valve brake system.

Therefore, the scope of the present application should not be determined by the above-described specific examples, but is defined by the claims.

What is claimed is:

1. A method for resetting a valve lift for an integrated engine brake, comprising a process of utilizing a motion of a cam to open an engine exhaust valve through a rocker arm and a valve bridge of an engine, wherein the rocker arm or the valve bridge is provided with a braking piston and a hydraulic flow passage, and the braking piston is connected to the hydraulic flow passage, wherein the process comprises the following steps: placing the braking piston at an extended position by supplying pressure to the hydraulic flow passage, providing a reset valve between the rocker arm and the valve bridge, wherein the reset valve does not transfer load from the cam to the engine exhaust valve, connecting the reset valve to a reset flow passage located in the rocker arm or the valve bridge, connecting the reset flow passage to the hydraulic flow passage, utilizing a change of a distance between the rocker arm and the valve bridge to open and close the reset valve, opening the reset valve when a valve lift of the engine exhaust valve enters into its top portion, releasing hydraulic pressure in the hydraulic flow passage through the reset flow passage, retracting the braking piston by a gap, eliminating a part of a motion transmission between the cam and the engine exhaust valve, reducing the valve lift of the engine exhaust valve, and during a returning process of the valve lift of the engine exhaust valve after passing its maximum position, closing the reset valve to resume pressure supply in the hydraulic flow passage, placing the braking piston at the extended position, and re-establishing the motion transmission between the cam and the engine exhaust valve.

2. The method for resetting a valve lift for an integrated engine brake according to claim 1, wherein the cam is integrated with a braking cam and a conventional cam of the engine, and comprises an enlarged conventional cam lobe and at least one braking cam lobe, the enlarged conventional cam lobe generates an enlarged conventional valve lift profile consisted of a bottom portion and a top portion, the bottom portion has approximately the same height as a braking valve lift profile generated by the at least one braking cam lobe, and the top portion is approximately the same as a conventional valve lift for an engine ignition operation generated by a conventional cam lobe of the engine.

3. The method for resetting a valve lift for an integrated engine brake according to claim 2, wherein the reset valve has an oil-feeding position and an oil-draining position, and at the oil-feeding position, the reset valve closes the reset oil passage; at the oil-draining position, the reset valve opens the reset oil passage, and the process of utilizing the motion of the cam to open engine exhaust valve through the rocker arm and the valve bridge of the engine comprises the following steps: 1) turning on a brake control mechanism to supply oil to the hydraulic flow passage, 2) positioning the reset valve at the oil-feeding position, closing the reset oil passage, and the braking piston being located at the extended position, 3) rotating the cam from an inner base circle toward the at least one braking cam lobe, 4) transmitting a motion from the at least one braking cam lobe of the cam to at least one exhaust valve through the rocker arm, the valve bridge and the braking piston, 5) rotating the cam over a bottom portion of the enlarged conventional cam lobe and upward to a top portion of the enlarged conventional cam lobe, driving the rocker arm to rotate and the valve bridge to make a downward translational motion, changing the distance between the rocker arm and the valve bridge, changing the reset valve from the oil-feeding position to the oil-draining position, opening the reset oil passage to drain oil, moving the braking piston in the exhaust valve actuator from the extended position to the retracted position, a part of a motion from the top portion of the enlarged conventional cam lobe of the cam being lost, and resetting the enlarged conventional valve lift profile generated by the enlarged conventional cam lobe to a conventional valve lift profile generated by the conventional cam lobe of the engine, 6) rotating the cam over the highest position of the enlarged conventional cam lobe and downward to the bottom portion of the enlarged conventional cam lobe, driving the rocker arm to rotate backward and the valve bridge to make an upward translational motion, changing the distance between the rocker arm and the valve bridge in an opposite way as in step 5), moving the reset valve from the oil-draining position back to the oil-feeding position due to the opposite change of the distance between the rocker arm and the valve bridge, closing the reset oil passage again, moving the braking piston in the exhaust valve actuator from the retracted position back to the extended position, and transmitting the motion from the at least one braking cam lobe of the cam to the exhaust valve through the exhaust valve actuator and the braking piston, 7) returning the cam to the position as in step 3), and starting a next braking cycle until the brake control mechanism is turned off with oil being discharged from the hydraulic flow passage and an engine braking operation being turned off.

4. A valve lift reset device for an integrated engine brake, comprising a cam, a rocker arm and a valve bridge of an engine, the rocker arm or the valve bridge being provided with a braking piston and a hydraulic flow passage, the braking piston being connected to the hydraulic flow passage, wherein the cam is integrated with a braking cam and a conventional cam of the engine and comprises an enlarged conventional cam lobe and at least one braking cam lobe, a valve lift reset mechanism is provided between the rocker arm and the valve bridge, the valve lift reset mechanism comprises a reset valve and a reset oil passage, the reset oil passage is located in the rocker arm or in the valve bridge, the reset valve does not transfer load from the cam to the engine exhaust valve and has an oil-feeding position and an oil-draining position, and at the oil-feeding position, the reset oil passage is closed by the reset valve; and at the oil-draining position, the reset oil passage is opened by the reset valve, and an action of the reset valve is coupled to a distance between the rocker arm and the valve bridge.

5. The valve lift reset device for an integrated engine brake according to claim 4, wherein the braking piston is integrated in the rocker arm.

6. The valve lift reset device for an integrated engine brake according to claim 4, wherein the braking piston is integrated in the valve bridge.

7. The valve lift reset device for an integrated engine brake according to claim 4, wherein the reset valve is one of the following devices or a combination of two or more of the following devices: a) a sliding-type plunger valve; b) a lifting-type plunger valve; c) a lifting-type ball valve; d) a lifting-type column valve; and e) a device being able to open and close the reset flow passage.

8. The valve lift reset device for an integrated engine brake according to claim 4, wherein the cam comprises an enlarged conventional cam lobe and one braking cam lobe.

9. The valve lift reset device for an integrated engine brake according to claim 4, wherein the cam comprises an enlarged conventional cam lobe and two braking cam lobes.

10. The valve lift reset device for an integrated engine brake according to claim 4, further comprising an anti-impact mechanism, wherein the anti-impact mechanism comprises a spring, and the spring is disposed between the braking piston and the rocker arm, or between the braking piston and the valve bridge, or between the rocker arm and the valve bridge, or between the rocker arm and the engine, or between the valve bridge and the exhaust valve.

11. A valve lift reset device for an engine, wherein the engine includes, a valve bridge, a cam that comprises an enlarged conventional cam lobe and a braking cam lobe, a rocker arm, wherein the rocker arm or the valve bridge includes a braking piston and a hydraulic flow passage, the braking piston being connected to the hydraulic flow passage, the valve lift reset device comprising:

a reset oil passage that is located in one of the rocker arm and the valve bridge, and a reset valve including an oil-feeding position and an oil-draining position, wherein when hydraulic pressure is applied to the braking piston through the hydraulic flow passage and when the distance between the rocker arm and the valve bridge is greater than a given value, the other of the rocker arm and the valve bridge is not in contact with the reset valve, the reset valve is in the oil-feeding position, and the reset oil passage is closed by the reset valve to maintain the hydraulic pressure applied to the braking piston, and wherein when the hydraulic pressure is applied to the braking piston through the hydraulic flow passage and when the distance between the rocker arm and the valve bridge becomes equal to or less than the given value, the other of the rocker arm and the valve bridge comes in contact with the reset valve to push the reset valve into the oil-draining position, and the reset oil passage is opened by the reset valve to release the hydraulic pressure applied to the braking piston.

12. The valve lift reset device according to claim 11, wherein the rocker arm includes the braking piston and the hydraulic flow passage.

13. The valve lift reset device according to claim 11, wherein the valve bridge includes the braking piston and the hydraulic flow passage.

14. The valve lift reset device according to claim 11, wherein the reset valve is one of the following devices or a combination of the following devices: a) a sliding-type plunger valve; b) a lifting-type plunger valve; c) a lifting-type ball valve; d) a lifting-type column valve; and e) a device being able to open and close the reset flow passage.

15. The valve lift reset device according to claim 11, further comprising an anti-impact mechanism, wherein the anti-impact mechanism comprises a spring, and the spring is disposed between the braking piston and the rocker arm, or between the braking piston and the valve bridge, or between the rocker arm and the valve bridge, or between the rocker arm and the engine, or between the valve bridge and the exhaust valve.

* * * * *